US007614987B2

(12) United States Patent
Guadagno

(10) Patent No.: US 7,614,987 B2
(45) Date of Patent: Nov. 10, 2009

(54) BALANCE AND MOTION EXERCISE TRAINING AN CONDITIONING DEVICE

(76) Inventor: Vincenzo Guadagno, 11 Kathleen Pl., Bridgewater, NJ (US) 08807-1815

( * ) Notice: Subject to any disclaimer, the term of this patent is extended or adjusted under 35 U.S.C. 154(b) by 44 days.

(21) Appl. No.: 11/153,075

(22) Filed: Jun. 15, 2005

(65) Prior Publication Data

US 2006/0287173 A1 Dec. 21, 2006

Related U.S. Application Data

(60) Provisional application No. 60/690,558, filed on Jun. 14, 2005.

(51) Int. Cl.
*A63B 26/00* (2006.01)

(52) U.S. Cl. ..... 482/142; 273/449

(58) Field of Classification Search ..... 482/51, 482/66, 68, 121–123, 146–148, 8, 71, 79, 482/80, 130, 142, 902; D21/662, 685, 686, D21/688, 689; 273/449
See application file for complete search history.

(56) References Cited

U.S. PATENT DOCUMENTS 3,511,499 A * 5/1970 Schawalder ..... 482/71
3,718,329 A 2/1973 Sabo
4,290,601 A 9/1981 Mittelstadt
4,376,532 A 3/1983 Hunstad
4,509,743 A 4/1985 Lie
4,669,723 A * 6/1987 Arsenian ..... 482/71
4,730,826 A 3/1988 Sudmeier
4,744,557 A 5/1988 Smirmaul
4,744,558 A 5/1988 Smirmaul
4,783,069 A * 11/1988 Cottee ..... 482/71
4,787,630 A 11/1988 Watson et al.
4,846,463 A 7/1989 Kleinnibbelink
4,911,430 A 3/1990 Flament
4,953,858 A 9/1990 Zelli
4,998,720 A 3/1991 Kim
5,125,880 A 6/1992 Peters
5,145,481 A 9/1992 Friedebach
5,147,257 A * 9/1992 Loane ..... 482/71
5,192,258 A * 3/1993 Keller ..... 482/71
5,242,340 A 9/1993 Jerome
5,295,930 A 3/1994 Hogan
5,312,258 A * 5/1994 Giorgio ..... 434/253
5,316,530 A * 5/1994 Romer ..... 482/71
5,342,265 A 8/1994 Creelman et al.

(Continued)

*Primary Examiner*—Loan H Thanh
*Assistant Examiner*—Tam Nguyen
(74) *Attorney, Agent, or Firm*—Porzio, Bromberg & Newman, P.C.

(57) ABSTRACT

The present invention is a device to simulate balance and motion activities of a user in response to the user's movements. The device has a curved sloping base with a top central area, a user support portion with a top and a bottom, a plurality of rolling elements coupled to the bottom of the user support portion, and a resilient element biasing the user support portion towards the top central area of the curved sloping base. The orientation of the user support portion relative to the top central area of the curved sloping base is responsive to movements of the user. The device provides a simple easy to use way to simulate balance and motion activities and thus condition and train a user conveniently and efficiently. The device conditions muscles in the legs and trunk as well as the balance mechanism while increasing endurance.

10 Claims, 6 Drawing Sheets

U.S. PATENT DOCUMENTS 5,413,545 A 5/1995 Bermann
5,429,567 A * 7/1995 Gerschefske et al. ..... 482/70
5,613,690 A * 3/1997 McShane et al. ..... 273/449
5,665,033 A 9/1997 Palmer
5,692,995 A 12/1997 Alvarez et al.
5,810,703 A 9/1998 Stack
5,813,864 A * 9/1998 Ikuta ..... 434/253
5,871,298 A 2/1999 Lekhtman et al.
5,941,803 A 8/1999 Chamberlain et al.
6,063,013 A 5/2000 Vathappallil
6,139,473 A * 10/2000 Koyama et al. ..... 482/8
6,213,924 B1 4/2001 Kaiyoorawongs
6,231,484 B1 5/2001 Gordon
6,508,746 B1 1/2003 Jacobs et al.
6,569,064 B1 5/2003 Loane
6,616,583 B1 9/2003 Stack
2001/0049322 A1 * 12/2001 Watanabe et al. ..... 482/8
2002/0137610 A1 9/2002 Broudy et al.
2002/0151417 A1 10/2002 List
2003/0032533 A1 2/2003 Hecox et al.
2004/0009859 A1 1/2004 Gottlieb
2006/0009329 A1 * 1/2006 Toyama et al. ..... 482/51

* cited by examiner

BALANCE AND MOTION EXERCISE TRAINING AN CONDITIONING DEVICE

CROSS REFERENCES TO RELATED APPLICATIONS

This application claims the benefit under 35 U.S.C. 119(e) of U.S. Provisional Application Ser. No. 60/579,608, entitled Dynamic Platform Multisport Exercise Device, filed on Jun. 15, 2004, and U.S. Provisional Application Ser. No. 60/690,558, entitled Balance And Motion Exercise Training And Conditioning Device, filed on Jun. 14, 2005.

FIELD OF THE INVENTION

This invention relates to exercise devices and more particularly to an exercise device which targets balance and motion activities.

BACKGROUND OF THE INVENTION

Today, more and more people engage in many seasonal sports without proper conditioning and training. In activities such as skiing, surfing, ice skating and similar sports which require balance and rapid motion the available seasons are limited and the availability of time to indulge often must compete with other activities, commitments and obligations. The cost of traveling to the location and the corresponding expenses at the resorts vary little if you only warm up or if you indulge extensively. An amateur participant or a competitive athlete desires to optimize their actual participation time and improve their performance.

A variety of exercise and physical therapy devices exist which can improve a particular motion or muscle group, but they lack the ability to simulate balance and motion activities and thus condition and train a user conveniently and efficiently.

Therefore there is a need to provide a simple easy to use device to simulate balance and motion activities and thus condition and train a user conveniently and efficiently.

SUMMARY OF THE INVENTION

The present invention is a device to simulate balance and motion activities of a user in response to the user's movements. The device has a curved sloping base with a top central area, a user support portion with a top and a bottom, a plurality of rolling elements coupled to the bottom of the user support portion, and a resilient element biasing the user support portion towards the top central area of the curved sloping base. The orientation of the user support portion relative to the top central area of the curved sloping base is responsive to movements of the user.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Although the present invention device to simulate balance and motion activities is particularly well suited for conditioning, training and exercising for downhill skiing and snowboarding and shall be so described herein, it is equally well suited for a variety of other balance and motion sports such as surfing, water skiing, skate boarding, wind surfing, luge (ice and road), tobogganing, ski jumping, telemarking (form of skiing using cross country skis), ice skating, hang-gliding, body surfing, kayaking and other sports.

Figure 1:
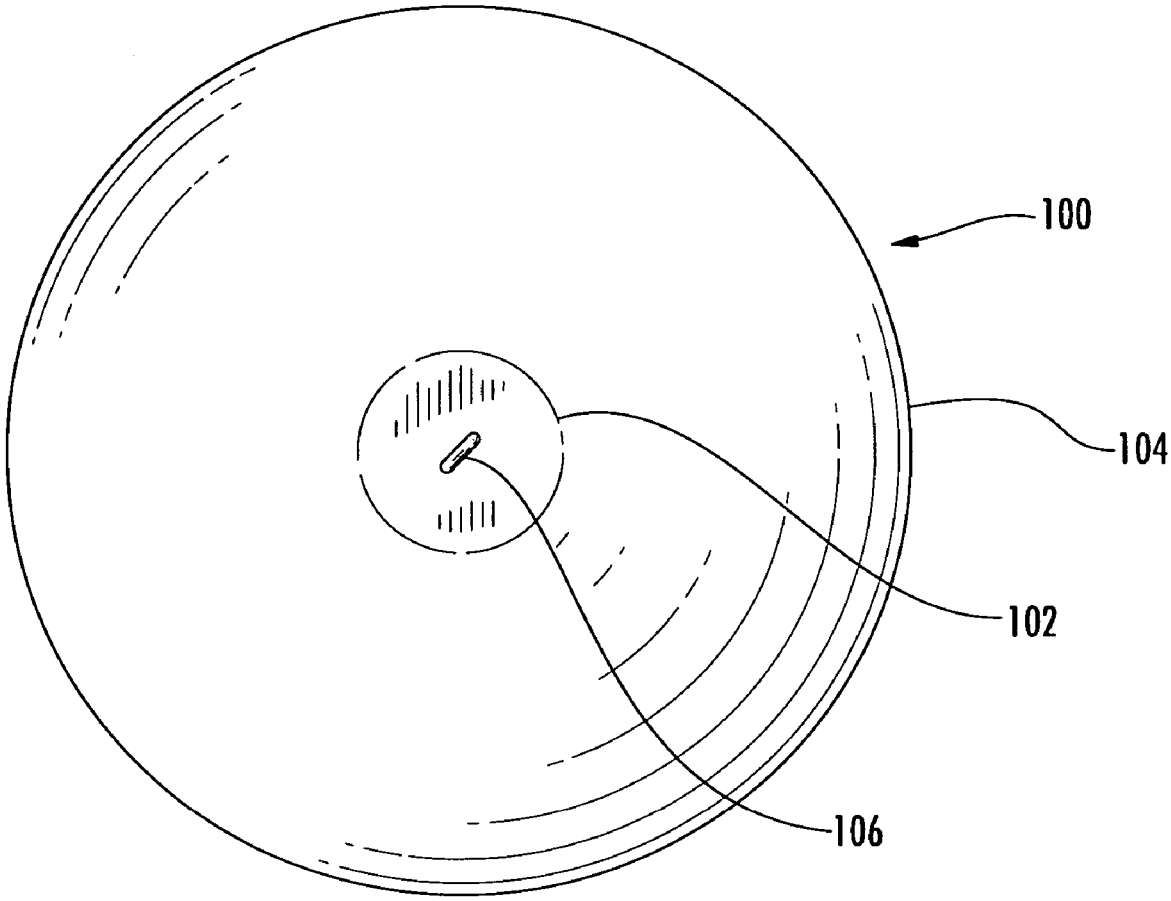
FIG. 1 is a top view of the shaped base.

The present invention is a device to simulate balance and motion activities of a user in response to the user's movements. Referring to FIG. 1 in conjunction with FIGS. 2*a* and 2*b* it can be seen that the device has a base 100 and a user support portion 200. There can be seen a curved sloping base 104 with a top central area 102, a user support portion 200 with a top and a bottom, a plurality of rolling elements 204 coupled to the bottom of the user support portion, and a resilient element 106 biasing the user support portion towards the top central area 102 of the curved sloping base 104. The orientation of the user support portion relative to the top central area 102 of the curved sloping base 104 is responsive to movements of the user.

Figure 2A:
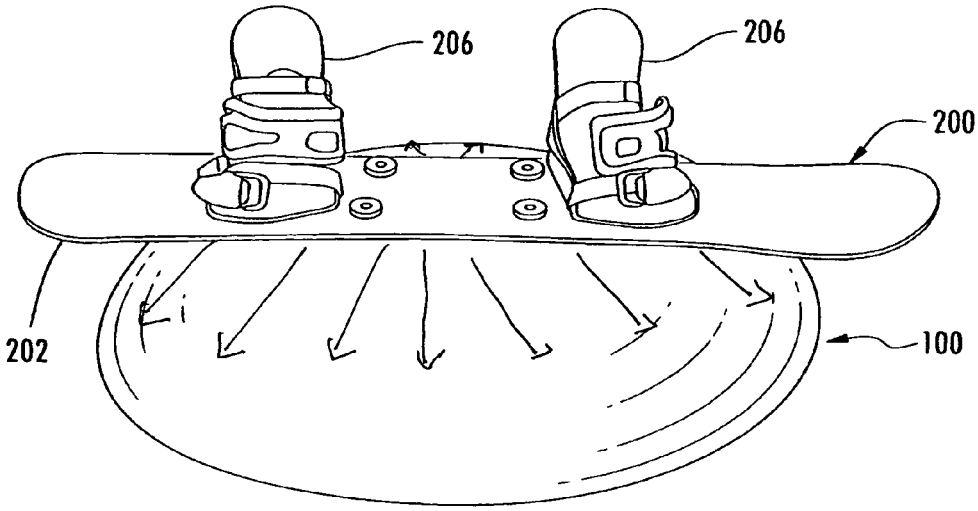
FIGS. 2*a* and 2*b* are perspective views with a snowboard user support attached to the shaped base.
Figure 2B:
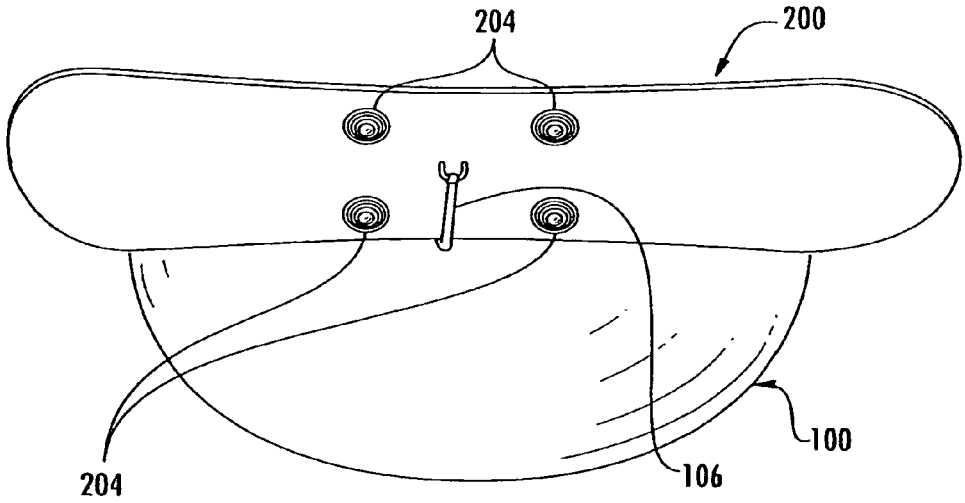

Referring back to FIGS. 1, 2*a* and 2*b*, it can be seen that the present invention device to simulate balance and motion activities (downhill skiing device) has a semi-spherical like shaped base 104 (although the shape may be varied to elliptical geometries to either increase or decrease the off peak slope changes) which may be varied in diameter. A user support mechanism 200 is attached to the shaped base 100 by an elastic tethering element 106, such as a bungee cord, elastic element or other suitable component. The elastic tethering element 106 biases the user support mechanism 200 toward the center area 102 of shaped support base 100. The user support mechanism 200 essentially allows the user to be coupled to the device in a way that will simulate a particular sporting activity. This ranges from a unitary structure such as for snowboarding, which is shown in FIGS. 2*a* and 2*b* to a dual structure which has limited freedom of motion between two attachment points 206 of the user's body to the primary element 202 to a more extensive flexible range of motion between two attachment points of the user's body which is shown in FIGS. 3*a* and 3*b*.

Figure 3A:
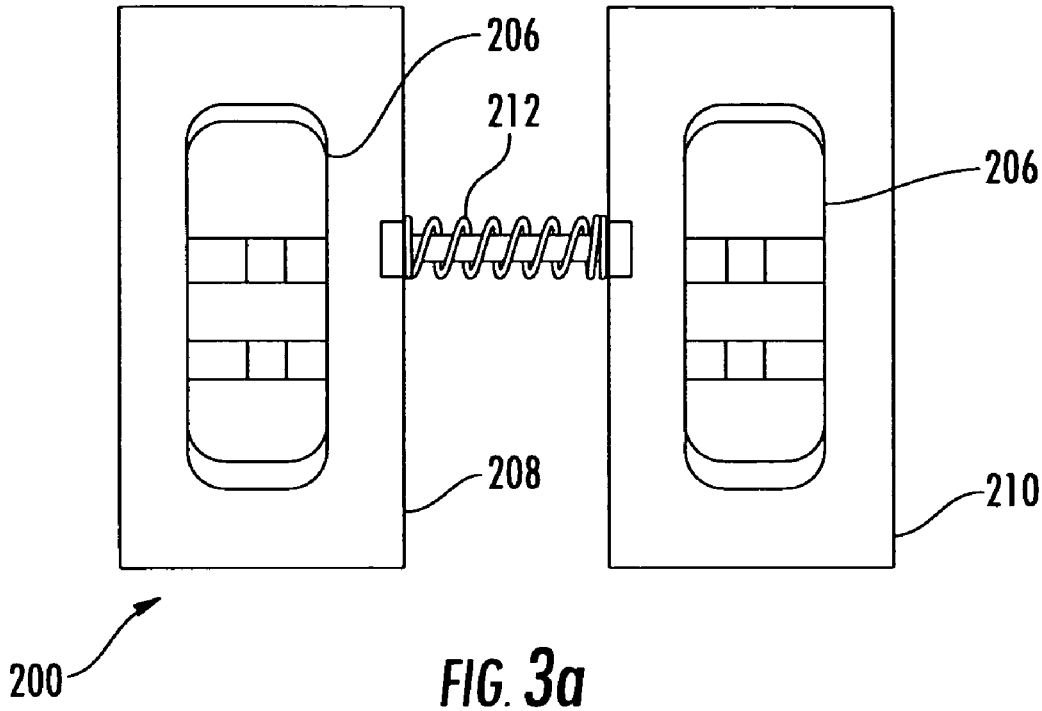
FIGS. 3*a* and 3*b* are a top and bottom view of a user support without foot coupling which provides motion relative to a user's feet.
Figure 3B:
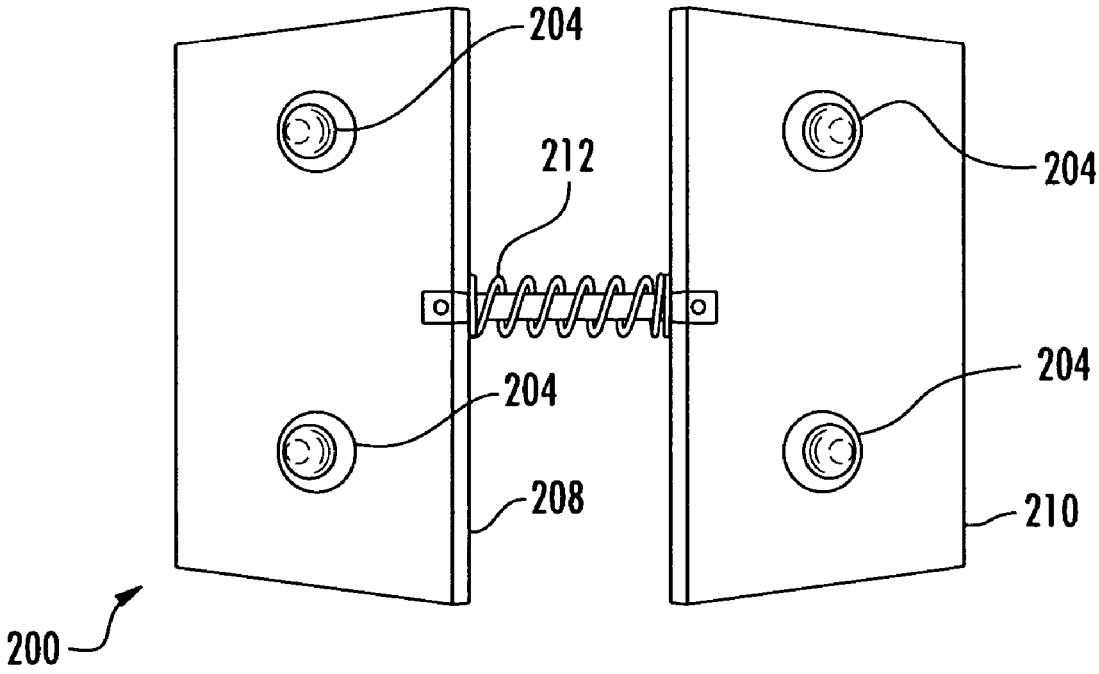

Referring to FIGS. 3*a* and 3*b* there can be seen a user support mechanism 200 that is comprised of two separate rectangular footplates 208 & 210 connected mid medially flexible coupling 212 which is a large metal spring, through which a thick rubber strap runs. The flexible coupling 212 is secured to each separate footplate 208 & 210. Under each footplate 208 & 210 are two rolling elements 204, of ball caster type, secured longitudinally which roll atop semi-spherical base 100. The user stands with one foot on each of two supporting footplates held in place by boots 206, which enable simulation of downhill skiing with each foot free to move semi-independently of the other. The two footplates 208 & 210 can flex and rotate relative to each other as well as move relative to the top central area 102 of the curved sloping base 104. A spring can be used to couple the footplates as well as a bungee, and other mechanical structures which allow various axis of relative motion between the footplates 208 & 210. The user may be attached to the two footplates 208 & 210 by a variety of boots 206, straps (including Velcro® and other coupling means), shoes, etc.

The shaped support base 100 must provide stability to the device. This can be accomplished by the base being weighted, having an extended area (which may be optionally detachable), as well as coupling the shaped support base to an external point.

The rolling elements 204 although described as a ball caster type can be a variety of different styles which enable the user support mechanism to easily slide over the shaped base with minimal frictional resistance. Spring-loaded casters can provide for a softer feel better simulating a snow covered surface. In addition to a variety of rolling elements when the shaped base has a suitable surface a corresponding low friction element may be used such as a Teflon® slide. Other rolling elements and low friction elements are known to those skilled in the art.

In one embodiment the user support 200 is shaped like a snowboard, which is shown in FIGS. 2*a* and 2*b*. Under the main element 202 which is a snow board snowboard are four ball castor elements 204 allowing the snowboard foot support mechanism to roll freely over semi-spherical base 100, attached at the center by elastic biasing element 106, thus simulating modem snowboarding. Support bases similar to those simulating ski motion, raised to higher profile, will simulate roller-skating and ice-skating.

One embodiment of the present invention device to simulate balance and motion activities has a semi-spherical base 100 with round side up comprised of molded synthetic material with hole running vertically through center, flared at top end. The semi-spherical base 100 is filled with non-compressible heavy material to prevent it from moving or collapsing under an adult user's weight. The semi-spherical base 100 is very low profile to allow gradual slope all around. The base also has handles (not shown) at one or two ends to allow easy movement. Elastic cord element 106 runs vertically through hole at center of base 100 attached to center of two user footplates 208 & 210. The user footplates 208 & 210, affixed on underside with two rolling ball castors 204 which articulate with the spherical spaded base and are connected to each other medially at center. Ball castors 204 are aligned lengthwise under the footplates 208 & 210, and are of hard molded vinyl ball type with spring-loaded feature allowing some give underfoot during exercise. This feature simulates compressible feel of snow on ski slope. User footplates 208 & 210 are connected medially/centrally by a spring element 212 which is flexible and strong allowing footplates to move separately yet remain securely tethered to elastic cord 106 in center of base 100.

Figure 4:
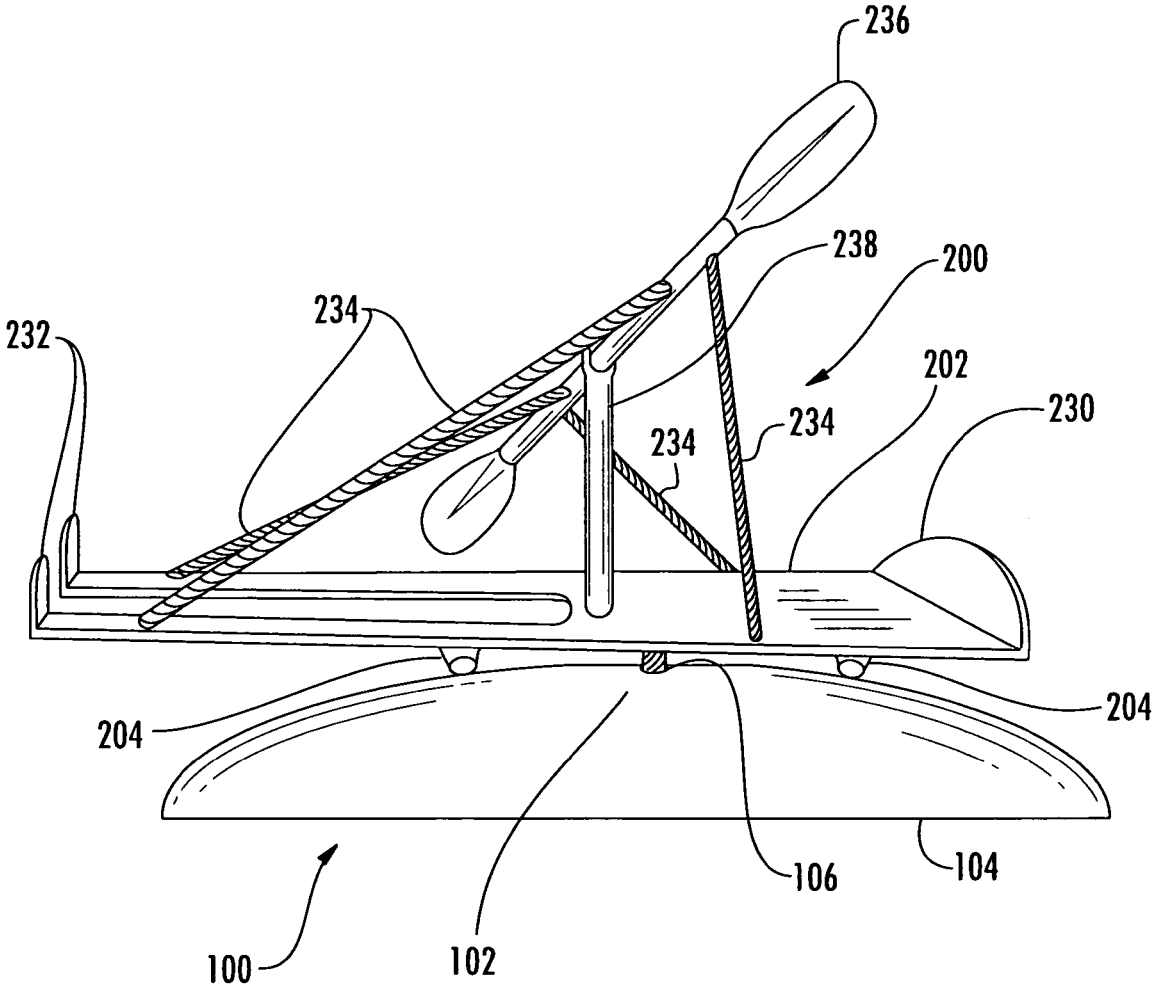
FIG. 4 is a side view with a kayaking user support attached to the shaped base.

Referring to FIG. 4 there is shown a support base 200 designed to sit will be used to simulate whitewater kayaking with seat mechanism supporting user in seated position. A seat 230 has leg supports 232 and rolling elements 204. Affixed between the leg elements 232 is a water paddle 236 with a vertical support element 238 and four elastic elements 234. The user moves their trunk from side-to-side and rotationally while seated on support 230, thus moving paddle 236 in a realistic right/left and rotational motion about a horizontal axis above the vertical support 238.

The present invention device to simulate balance and motion activities allows practice and a user is able to repeat the actual repetitive motions of a particular balance and motion sport or activity. The present invention can be used for conditioning and preconditioning to prevent or at least reduce the soreness and injuries that occur at the start of the season. Additionally, the present invention can be used for physical therapy at home or in a physical therapy facility. The present invention device to simulate balance and motion activities trains muscles in the legs and trunk as well as the balance mechanism while increasing endurance.

Another embodiment of the present invention device to simulate balance and motion activities simulates downhill skiing, snowboarding and also water kayaking. The device trains muscles in legs and trunk as well as balance mechanisms used in all said sports, while increasing endurance needed. The device is composed of base with foot plates resting at top of the dome base, with rolling elements affixed to underside of said foot plates providing articulation between said base and foot plates and motion in all directions atop base. Footplates are connected by metal framework which allows limited rotation about a longitudinal axis along length of each footplate dampened by spring mechanism between said frame and footplate, simulating pronation/supination used in skiing to edge skies into snow. The said footplates are secured to base by elastic element attached to said frame, extending down through middle of dome base.

The user thus stands on the footplates and moves feet laterally as well as rotationally simulating downhill ski motion The elastic band acts to keep footplates attached to base, while giving user feedback as the footplates reach edge of base in the form of increasing resistance. The user can hold ski poles to help balance while learning motion and giving authentic ski feel. Ski poles can be optionally attached to base.

Another embodiment of the present invention device simulates balance and motion activities simulate snowboarding by replacing footplates with replica snowboard footplate also with rolling elements affixed to underside and secured to the base with elastic element. The replica snowboard footplate with rolling elements will allow user to slide and tilt snowboard footplate while rotating it simulating downhill snowboarding, with elastic element providing guide feedback returning footplate and user back toward center.

Footplates are equipped with straps at front and rear end to secure users feet during exercise. Footplates are raised medially and laterally on underside to allow contact with spherical base during exercise simulating ski edge. The medial edges have central relief to allow elastic stretch cord from semi-spherical base to pass without excessive wear.

Exercise device for simulating Alpine Snowboarding using same semi-spherical base above has a separate snowboard foot support with four rolling ball castors on underside to articulate with semi-spherical base. Ball castors are of identical construction as above.

An exercise device to simulate Ice and Roller Skating uses the same semi-spherical base and has two separate footplates with slightly higher profiles, each equipped with ball type castors affixed to underside articulating with spherical base. The higher profiles enables a user's feet to be elevated to provide the higher profile and different pivot points that ice skating presents. Ball castors are similar to those above, but are not spring loaded to give harder feel better simulating skating activities. Footplates are loosely attached medially and centrally with more flexible spring cord than above, to allow more freedom of foot movement than above. Center of spring cord is tethered to stretch cord in center of spherical base. Each footplate support is equipped with straps to secure users feet. The curved sloping base can be textured to simulate rough surfaces.

For surfing, the user support will look similar to the snowboard attachment but a bit wider and longer while not large enough to obscure any view of the dome base or contact the ground while in use. The use will also be similar to the snowboard except movements would be wider and more sweeping similar to a normal surfing movement.

For water skiing the support for the waterskiing activity would be similar to a real water ski, though maybe not quite as long, with feet placed one behind the other in the middle of the ski. The movement will be a wide slow sweeping movement from side to side as in a simulated waterskiing movement.

For skate boarding the support mechanism for skateboarding would be almost identical to the snowboarding unit, though just a bit smaller. And the exercise itself would be very similar to snowboarding as the two sports are very similar, but for the terrain on which each is performed. The curved sloping base can be textured to simulate rough surfaces.

For wind surfing the support mechanism would be similar to the surfboarding mechanism, except that a vertical rod would be installed in the middle where user stands. On the rod would be installed a handle similar to that used on windsurfer. This trainer would allow the user to train muscle and weight distribution/coordination necessary for windsurfing. It would not entail much rapid and repetitive movement.

For luge the support mechanism for this trainer would be designed with a long horizontal flat padded board to allow user to lie supine during exercise. Velcro or buckle straps over upper legs and chest area would prevent user from falling off device, while performing side-to-side movements with slight rotation, both in longitudinal and transverse planes, while trying to maintain horizontal over dome base.

For tobogganing the support mechanism for this trainer would entail simply a seat with some lateral support and handle for user to grip during exercise. The user would perform lateral movements with some rotation over dome base trying to maintain horizontal balance, similar to actual toboggan sport.

For ski jumping the support mechanism for this trainer would be identical to ski trainer, which spring loaded ball transfers under footplates. The movement would be forward then a thrust up to obtain separation and lift from the dome base. The elastic cord would provide resistance to the user, building strength and power, and the spring-loaded castors would cushion landing back to dome base. The user would also improve balance for takeoff and landing of the ski jump, whether for freestyle, conventional or competitive jumping.

For telemarking the support mechanism for this trainer would be identical to ski trainer, except that users feet would be strapped only over the toes. This design would allow the user to move laterally on the trainer as he does with ski trainer, except it would allow user to flex inside leg during lateral push while heel lifts off the footplate of inside leg. This action simulates the downhill ski technique used by cross-country skiers so they can continue to use their same skis while on downhill slope. It is a very difficult technique, which could be improved on the trainer before going on steep mountain slopes, for better efficiency.

For hang-gliding the object is to remain parallel to the ground as the kite (glider) moves through the air. The user must shift their weight subtlety side-to-side or front to back. A two part user support mechanism both rolls, and rotates in the same plane thus allowing the user to remain parallel to the ground, not the dome base. While the user would of course not be suspended from a kite but resting on the support mechanism the body movements would be the same which is the objective.

Figure 5A:
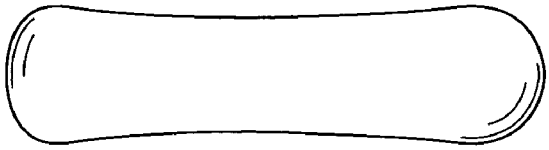
FIGS. 5*a*, 5*b*, 5*c* and 5*d* are various embodiments of user support portions.
Figure 5B:
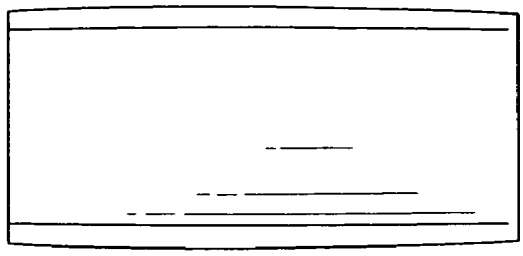
Figure 5C:
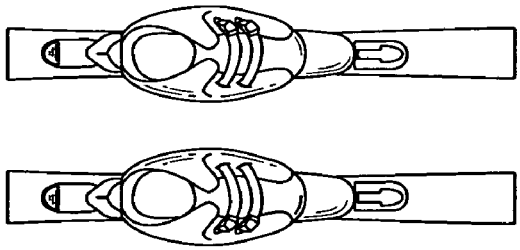
Figure 5D:
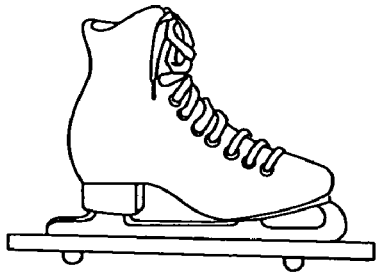

Referring to FIG. 5*a* a user support portion for simulating a skateboard can be seen. Referring to FIG. 5*b* a user support portion for simulating a surfboard can be seen. Referring to FIG. 5*c* a user support portion for simulating skis can be seen. Referring to FIG. 5*d* a user support portion for simulating skates can be seen.

The advantage to using physical motion cannot be over emphasized in view of the increasing sedentary life styles that children and adults are adopting. To further enhance the simulation balance and motion activities of a user in response to the user's movements a visual interface can be included. By sensing the movements of the user, such as position, the device can essentially form the basis for a game interface wherein rather than a hand moved joystick or the visual interpretation of a user's movements, the actual motion and position of a user is sensed and used as a whole body motion controller. In its simplest form the present invention device to simulate balance and motion activities of a user in response to the user's movements adds entertainment as well as enables a user to visually observe the effects of their movements, thus further simulating the actual sport. In a more complex system, the present invention device to simulate balance and motion activities of a user in response to the user's movements acts as an input device for a computer type game. Thus a user simulating the use of a skateboard can actually see the actions they take in a skateboard game, such as Tony Hawk's Underground 2™, would review visual feedback from actual their movements, thus simulating their actions in a skateboard park with actual movements.

Figure 6:
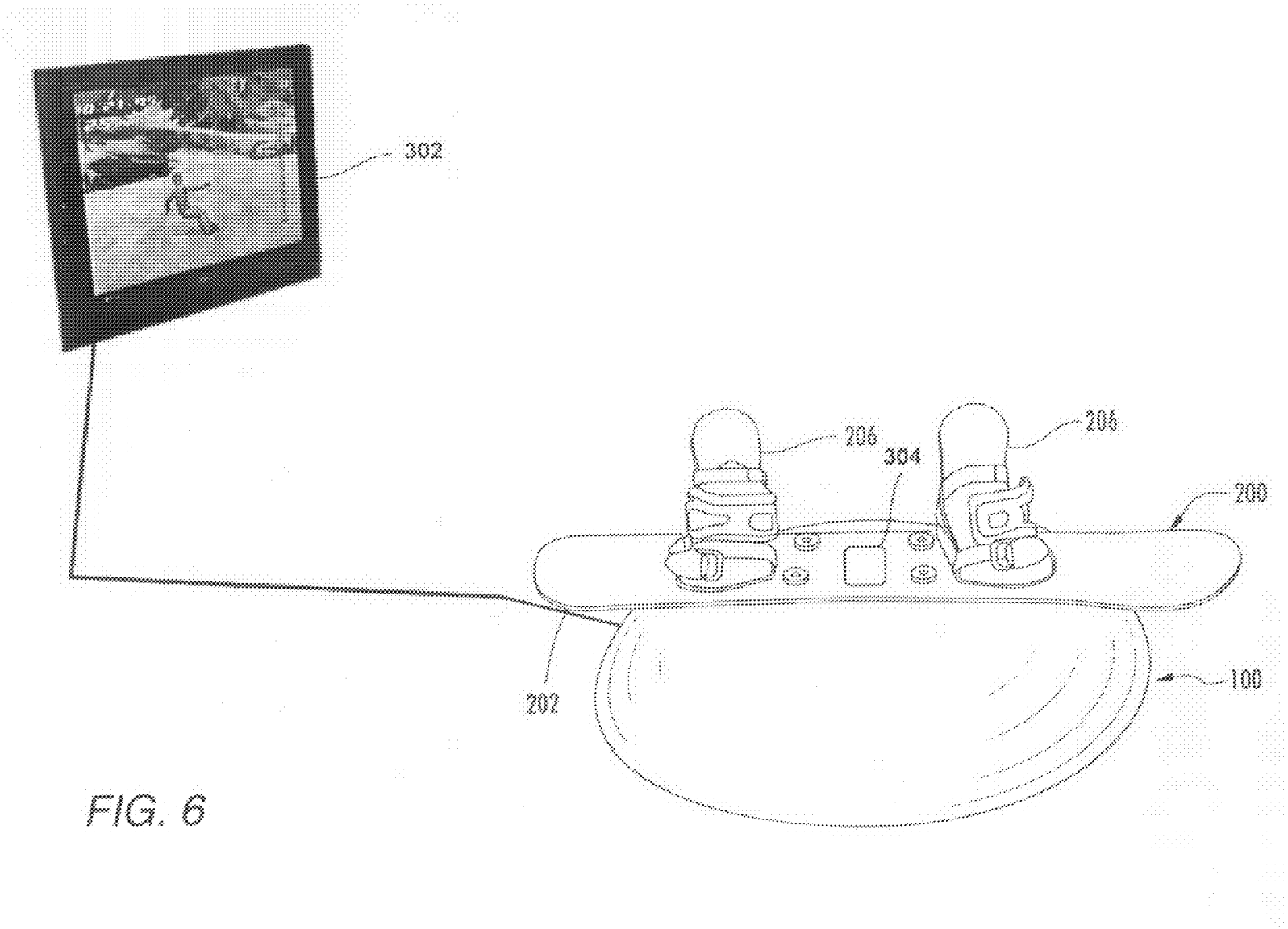
FIG. 6 is a high level illustration of a snowboard training user support interface adapted to the balance and motion exercise, training and conditioning device with visual feedback.

Referring to FIG. 6 a high level illustration of a snowboard training user support interface adapted to the balance and motion exercise, training and conditioning device with visual feedback is shown. A motion sensor 304 is shown positioned on the top of snowboard 202. The motion sensor 304 can be an accelerometer, strain gauge or other device for sensing position and/or motion. Although shown mounted on the top of the snowboard 202, the motion sensor 304 may be under or within the snowboard 202. A visual interface includes a display or display interface 302 which is coupled to the motion sensor.

Numerous modifications and alternative embodiments of the invention will be apparent to those skilled in the art in view of the foregoing description. Such as a variety of other configurations relating to the foot strap or boot, user support structure shape, etc. are equally well suited. A strain gain and accelerometer or similar device can be used to provide an indication of amount of force and rate of motion change as well as indicate the level of balance a user has obtained. When used as a game input interface, multiple users can play, joining each other from remote locations in a common virtual location. Accordingly, this description is to be construed as illustrative only and is for the purpose of teaching those skilled in the art the best mode of carrying out the invention. Details of the structure may be varied substantially without departing from the spirit of the invention and the exclusive use of all modifications, which come within the scope of the appended claim, is reserved.

I claim:

1. A device to simulate balance and motion activities of downhill skiing or snowboarding of a user in response to the user's movements, the device comprising: a curved downwardly sloping base having, a top central area; a user support mechanism having a top surface and a bottom surface, said user support mechanism further comprises a device for securing the user's foot to said top surface of said user support mechanism; a plurality of rolling elements coupled to said bottom surface of said user support mechanism, said rolling elements adapted to roll freely atop said curved downwardly sloping base; and, a resilient element attached to a center of said base and attached to a center of said support mechanism, said resilient element biasing said user support mechanism towards said top central area of the curved downwardly sloping base; wherein said user support mechanism is enabled to move laterally and rotationally over the curved downwardly sloping base for simulating said downhill skiing or snowboarding motions whereby orientation of said user support mechanism relative to said top surface of the curved downwardly sloping, base is responsive to movements of the user, and said device for securing the user's foot retains the user's foot on the support mechanism when said support mechanism is lifted off said base.

2. The device to simulate balance and motion activities of a user in response to the user's movements as recited in claim 1 wherein said user support mechanism provides support of the user's legs relative to each other.

3. The device to simulate balance and motion activities of a user in response to the user's movements as recited in claim 2 wherein said user support mechanism resembles a snowboard.

4. The device to simulate balance and motion activities of a user in response to the user's movements as recited in claim 1 wherein said curved downwardly sloping base is approximately a spherical section.

5. The device to simulate balance and motion activities of a user in response to the user's movements as recited in claim 1 wherein said rolling elements are spring cushioned.

6. The device to simulate balance and motion activities of a user in response to the user's movements as recited in claim 1 wherein said rolling elements are casters.

7. The device to simulate balance and motion activities of a user in response to the user's movements as recited in claim 1 wherein said rolling elements are spring casters.

8. The device to simulate balance and motion activities of a user in response to the user's movements as recited in claim 1 wherein said curved downwardly sloping base is approximately hyperbolic.

9. The device to simulate balance and motion activities of a user in response to the user's movements as recited in claim 1 wherein said device for securing the user's foot to said top surface of said user support mechanism is a boot.

10. The device to simulate balance and motion activities of a user in response to the user's movements as recited in claim 1 wherein said device for securing the user's foot to said top surface of said user support mechanism is a strap.

* * * * *